US008070422B1

(12) United States Patent
Liang

(10) Patent No.: US 8,070,422 B1
(45) Date of Patent: Dec. 6, 2011

(54) TURBINE STATOR VANE AND ROTOR BLADE ARRANGEMENT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 569 days.

(21) Appl. No.: 12/335,565

(22) Filed: Dec. 16, 2008

(51) Int. Cl.
*F01D 5/14* (2006.01)

(52) U.S. Cl. ..... 415/115; 416/96 R; 416/97 R

(58) Field of Classification Search ..... 416/96 R, 416/97 R, 191; 415/115, 116
See application file for complete search history.

(56) References Cited

U.S. PATENT DOCUMENTS 3,945,758 A * 3/1976 Lee ..... 415/144
6,077,035 A * 6/2000 Walters et al. ..... 415/115
6,082,961 A * 7/2000 Anderson et al. ..... 415/115
6,481,959 B1 * 11/2002 Morris et al. ..... 415/115
6,830,432 B1 * 12/2004 Scott et al. ..... 416/97 R
7,097,417 B2 * 8/2006 Liang ..... 415/115
7,578,653 B2 * 8/2009 Klasing et al. ..... 415/115
7,648,333 B2 * 1/2010 Tibbott et al. ..... 415/115

* cited by examiner

*Primary Examiner* — Kiesha Bryant
*Assistant Examiner* — Mark Tornow
(74) *Attorney, Agent, or Firm* — John Ryznic

(57) ABSTRACT

A turbine rotor blade and stator vane assembly in which the rotor blades include a cooling air discharge slot formed within the blade platform to discharge cooling air toward a surface of the adjacent vane to prevent formation of a vortex flow over the region of the vane where the vane airfoil and the inner endwall merges around the fillet. The rotor blade includes a row of exit holes to discharge cooling air from an impingement cavity to provide cooling for the trailing edge. The platform injection cooling air ejection slot is connected to the impingement cavity and provides cooling for the platform and injection of cooling air to break down the formation of the vortex on the vane endwall region.

17 Claims, 5 Drawing Sheets

TURBINE STATOR VANE AND ROTOR BLADE ARRANGEMENT

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a rotor blade and stator vane arrangement to reduce pressure side vortices on the vanes.

2. Description of the Related Art Including Information Disclosed Under 37 CFR 1.97 and 1.98

A gas turbine engine includes multiple stages of stator vanes and rotor blades in the turbine section that are exposed to a high temperature gas flow. The stator vanes guide the hot gas flow into the adjacent and downstream rotor blades in order to increase the performance of the turbine.

As the hot gas flow entering the turbine with a boundary layer thickness and reacts with the leading edge of the vane airfoil, a horseshoe vortex 10 separates into pressure side vortex 11 and a suction side vortex 12 as seen in FIG. 1. Initially, the pressure side vortex 11 sweeps downward and flows along the airfoil pressure side forward fillet region first. Then, due to the hot gas flow channel pressure gradient occurring between the pressure side to the suction side, the pressure side vortex 11 migrates across the hot flow passage and ends up at the suction side (13 in FIG. 2) of the adjacent airfoil. As the pressure side vortex 11 rolls across the hot gas flow channel, the size and strength of the passage vortex 15 becomes larger and stronger. Since the passage vortex 15 is much stronger than the suction side vortex 12, the suction side vortex 12 flows along the airfoil suction side fillet and acts as a counter vortex for the passage vortex 15. These vortices formation for a boundary layer entering the turbine airfoil can be seen in FIG. 1. As a result of the vortices flow phenomena, some of the hot core gas flow from the upper airfoil span is transferred toward close proximity to the endwall and thus creates a high heat transfer coefficient and high gas temperature region at the airfoil fillet region.

As shown in FIG. 1, the resulting forces drive the stagnated flow 21 that occurs along the airfoil leading edge towards the region of lower pressure at the intersection of the airfoil and endwall. This secondary flow flows around the airfoil leading edge fillet and endwall region. This secondary flow 21 then rolls away from the airfoil leading edge and flows upstream along the endwall against the hot core gas flow 20 as seen in FIGS. 2 and 3. As a result, the stagnated flow forces acting on the hot core gas and radial transfer of hot core gas flow from upper airfoil span toward close proximity to the endwall and creates a high heat transfer coefficient and high gas temperature region at the intersection location.

In the prior art, injection of film cooling air at discrete locations along the horseshoe vortex region is used to provide the cooling for this design. However, there are many drawbacks for this type of film blowing injection cooling and includes the following. A high film effectiveness level is difficult to establish and maintain in the high turbulent environment and high pressure variation region such as the horseshoe vortex region. Film cooling is very sensitive to pressure gradient. The mainstream pressure variation is very high at the horseshoe vortex location. The spacing between the discrete film cooling holes and areas immediately downstream of the spacing are exposed to less or no film cooling air. Thus; these areas are more susceptible to thermal degradation and metal over-temperature and shorten the life of the airfoil.

FIGS. 4 and 5 shows a stator vane with a leading edge and a pressure side of the airfoil, with an endwall having a fillet where the endwall merges into the airfoil. The horseshoe vortex region 23 is located in the leading edge and porous plug cooling holes 24 open onto the endwall in this location. Discrete pressure side film cooling holes 25 are on the airfoil just above the fillet. FIG. 4 shows the suction side film cooling holes 26 along the trailing edge section.

For the rotor blade trailing edge root section of the prior art, due to the hot gas migration from blade upper span down to the trailing edge versus the platform region, the blade aft fillet region experiences hotter gas temperature. Also, at the blade trailing edge fillet location, due to the stress concentration issue, the cooling slot for the airfoil trailing edge root section cannot be located low enough into the blade root section fillet region to provide proper convective cooling. Cooling of this particular blade trailing edge root fillet region becomes especially difficult.

BRIEF SUMMARY OF THE INVENTION

It is an object of the present invention to provide for a turbine stator vane and rotor blade arrangement in which the prior art pressure side vortex flow separation is reduced.

Another object of the present invention is to provide for a turbine stator vane and rotor blade arrangement with cooling flow injection at the blade trailing edge root section upstream of the vane airfoil that is used to improve the vane airfoil vortex cooling.

To overcome the above described problems with the flow separation and the vane cooling issues, the present invention provide for a turbine rotor blade with a cooling air injection slot located on the blade platform that opens in a direction that injects cooling air into the location on the adjacent stator vane above the fillet region on the inner endwall and toward the leading edge in order to break down the horseshoe vortex formation that forms in the prior art. The cooling air provides cooling for the blade root section fillet region and injects cooling air onto the downstream vane region to break down the vortex. An extended root slot is used to inject cooling air at the vane leading edge vortex region. Cooling air is bled off through the blade root section impingement cavity and metered into an angled cooling air injection channel located below the airfoil root section fillet region to provide the proper aerodynamic angle for the cooling air directed at the vane vortex region.

DETAILED DESCRIPTION OF THE INVENTION

Figure 1:
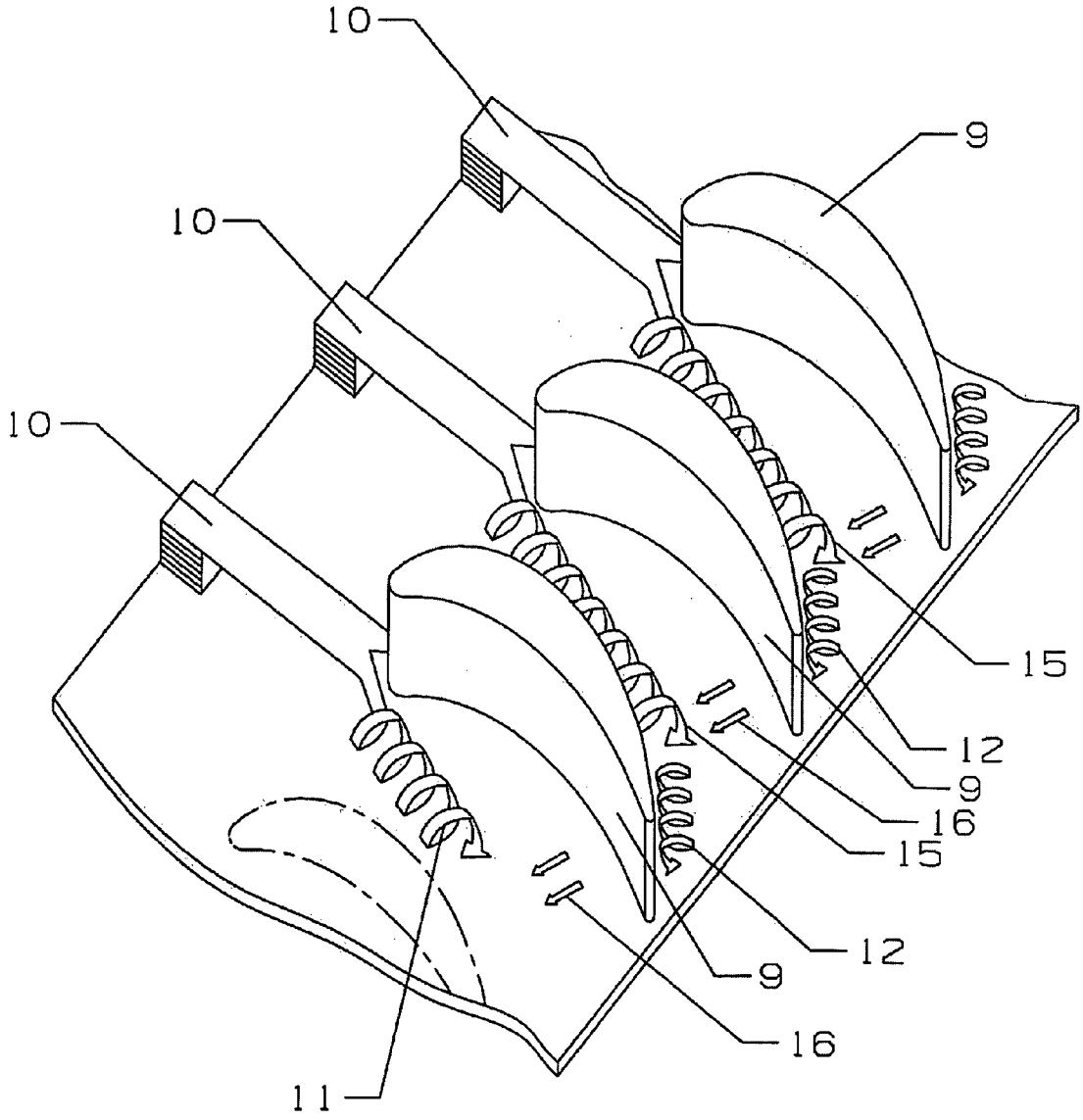
Fig 1 Prior Art
FIG. 1 shows a section of a schematic view of a Vortex formation flow for a turbine vane assembly.
Figure 2:
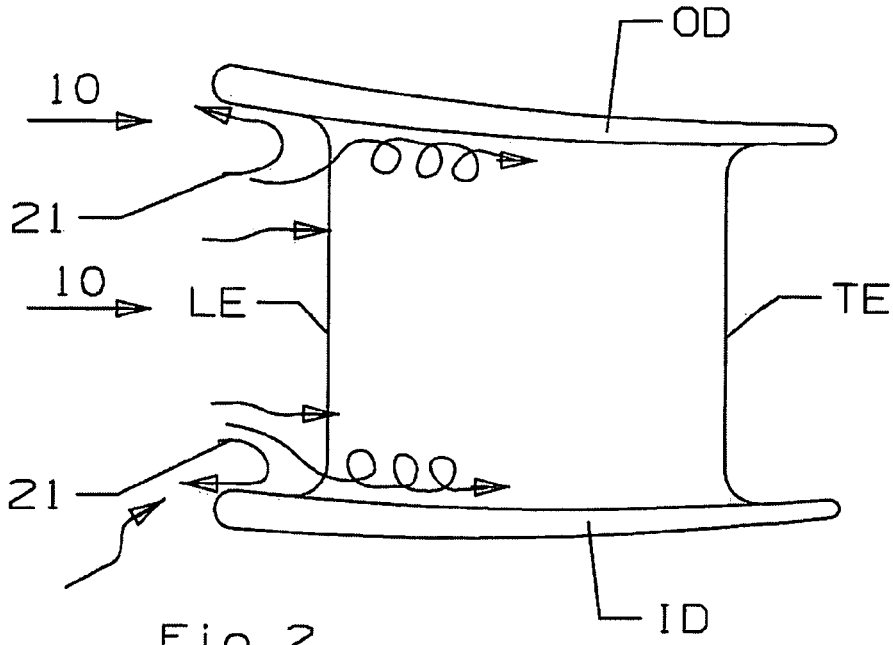
Fig 2 Prior Art
FIG. 2 shows a cross section side view of a turbine vane with secondary flow directions.
Figure 3:
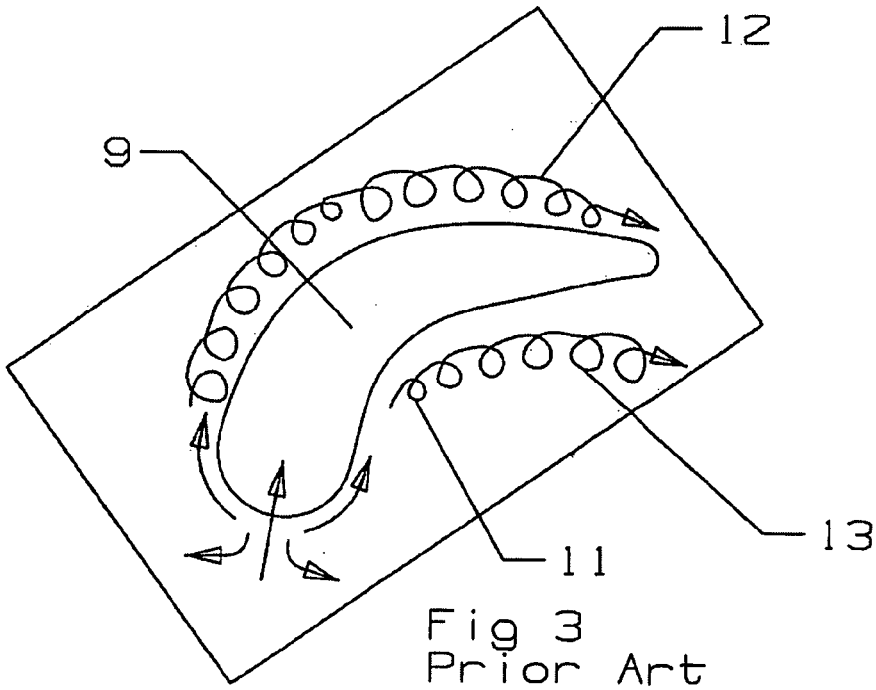
Fig 3 Prior Art
FIG. 3 shows a cross section top view of the turbine vane of FIG. 2 with the secondary flow directions.
Figure 4:
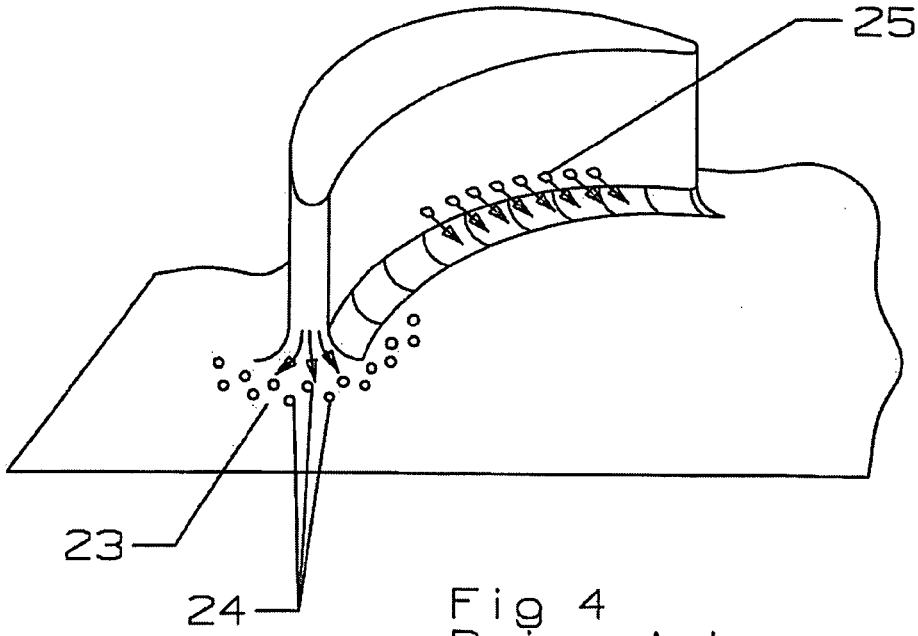
Fig 4 Prior Art
FIG. 4 shows a schematic view of a turbine vane on the pressure side and leading edge side with the location of the fillet region cooling holes of the prior art.
Figure 5:
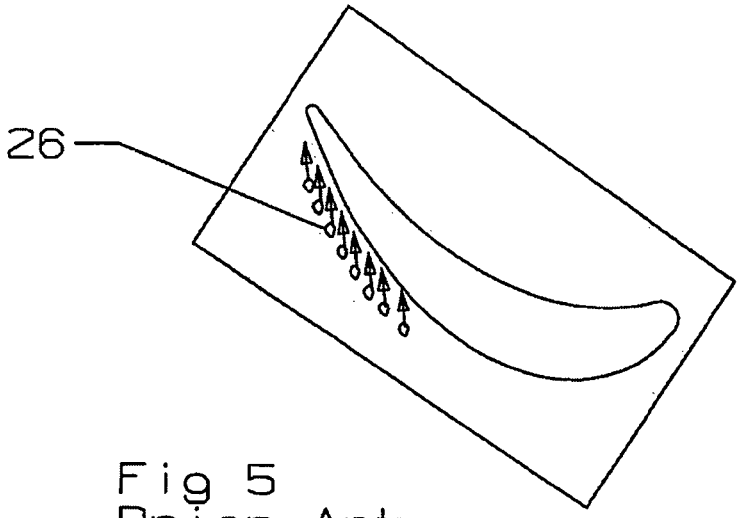
Fig 5 Prior Art
FIG. 5 shows a top view of the turbine vane of the prior art with the location of the suction side film cooling holes.
Figure 6:
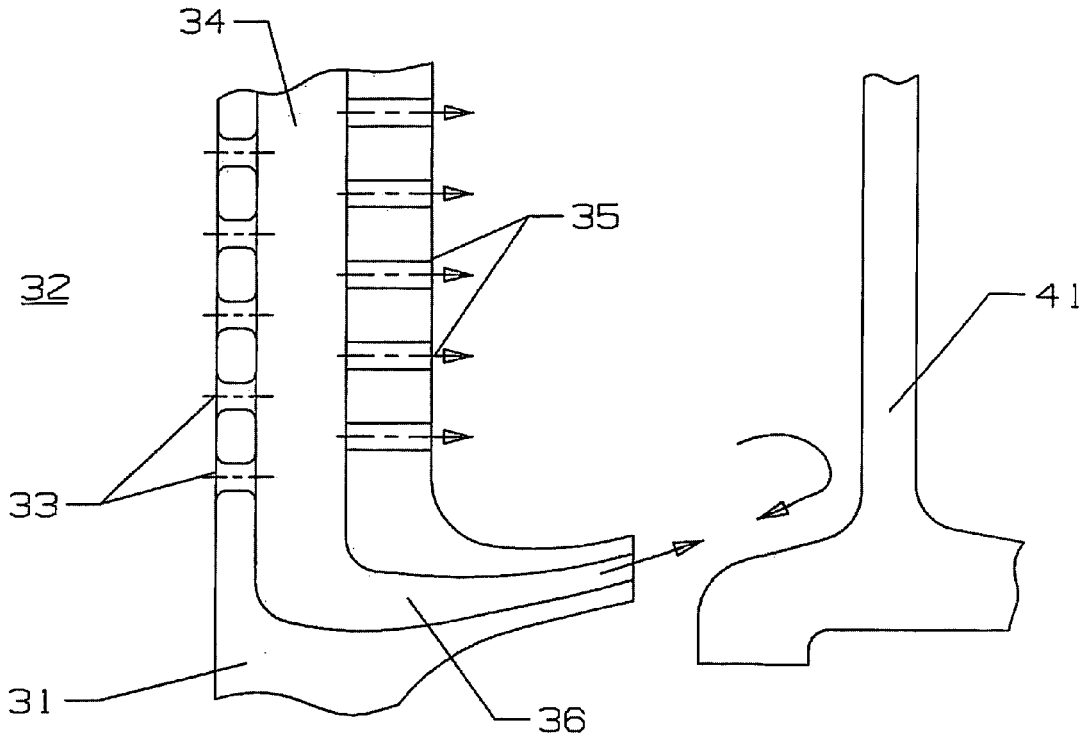
FIG. 6 shows the turbine blade and vane arrangement with the cooling air injection passage used in the present invention.
Figure 7:
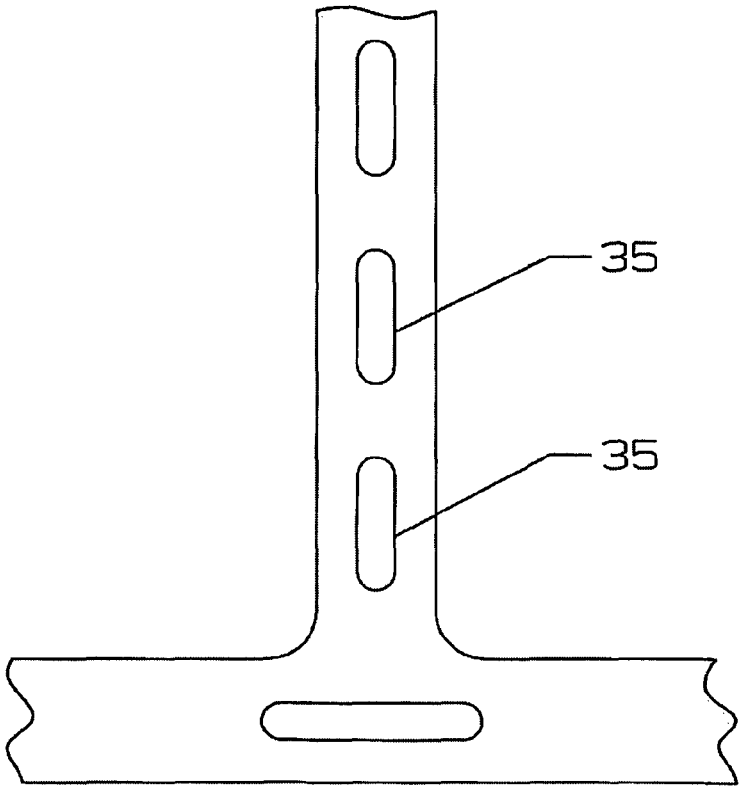
FIG. 7 shows a rear view of the rotor blade of the present invention having, the discharge slot.

In order to reduce the formation of the vortex flow that appears on the stator vanes of the prior art, the present invention includes a cooling air discharge slot on the platform of the rotor blade as seen in FIGS. 6 and 7. FIG. 6 shows a side view of a turbine rotor blade and stator vane assembly with a first stage rotor blade 31 located immediately upstream in the hot gas flow direction from a second stage stator vane 41. The rotor blade 31 includes an impingement cavity 32 that forms part of the cooling circuit for the blade and supplies cooling air to the trailing edge region. A row of impingement holes, 33 meters the cooling air into an impingement cavity 34 formed alongside the trailing edge of the blade. A row of trailing edge cooling holes or slots 35 discharges cooling air out from the blade.

Located on the bottom of the blade and in the platform is a cooling air injection slot 36 that is connected to the impingement cavity 34 for the supply of cooling air that is used to inject toward the stator vane. The location and the direction of discharge of the cooling air from the slot 36 is such that cooling air flows into the vortex flow region along the vane endwall on the pressure side and in a direction against the hot gas core flow. FIG. 7 shows a cross section backside view of the rotor blade along the trailing edge with the exit holes 35 and the discharge slot 36 opening onto the end of the platform. The discharge slot 36 is much wider than the exit holes 35 due to the trailing edge being thin while the platform is wide but narrow. The discharge slot 36 is shaped so that the cooling air increases in velocity toward the opening of the slot. The cooling air injection slot has an injection direction inline with the downstream wall of the adjacent vane and slightly displaced in a radial direction from the surface of the endwall as seen in FIG. 6.

The cooling air supplied to the trailing edge region passes through the exit holes and into the injection slot 36 to provide cooling for the trailing edge of the blade and to cool the platform. The spent cooling air from the injection slot 36 is then used to break down the vortex flow formed on the vane airfoil.

The present invention is explained for use in the first stage rotor blade and second stage stator vane assembly. However, the injection slot can be used on other stages of rotor blades to provide the additional cooling of the blade platform and to break down the vortex flow on the vane airfoil if the vortex flow is developed on these other stages.

Advantages of the present invention over the prior art is described below. The metering cooling air ejection channel provides additional cooling for the blade root section fillet location and thus lowers the fillet region metal temperature and increases the blade high cycle fatigue (HCF) capability. Cooling slot undercuts the blade fillet location which softens the trailing edge stiffness and enhances the blade low cycle fatigue (LCF) capability. The ejected cooling air exits from the cooling slot breaks down the vortex formation for the downstream vane leading edge root section. The metering injection cooling slot connects to the end of the trailing edge impingement cavity and can, function as a ceramic core support for an improvement in the blade casting yields. The injected cooling air exits from the blade root slot to provide cooler endwall temperature for the downstream vane component. A cooler vane endwall is achieved without the vortices formation on the endwall surface. By minimizing the turbulent mixing on the vane endwall, a better aerodynamic performance for the turbine stage is achieved. By the elimination of the turbulent mixing on the vane endwall, a better film cooling effectiveness for the vane endwall is achieved.

I claim the following:

1. A gas turbine engine comprising:

A row of rotor blades, each rotor blade having a blade platform and a row of exit cooling holes connected to an impingement cavity to discharge cooling air from the blade and out from the trailing edge of the blade;

A cooling air injection slot located in each blade platform and connected to the impingement cavity;

A row of stator vanes located adjacent to and downstream from the row of rotor blades;

The row of stator vanes each having an inner endwall located adjacent to the rotor blade platforms and pressure sidewall fillet location; and, The cooling air injection slots directed to discharge the cooling air toward the stator vane inner endwalls and pressure side wall fillet locations.

2. The gas turbine engine of claim 1, and further comprising:

The cooling air injection slots are located below the exit cooling holes in the trailing edge of the blade.

3. The gas turbine engine of claim 2, and further comprising:

The cooling air injection slots have a width of at least twice the height.

4. The gas turbine engine of claim 1, and further comprising:

The rotor blades are the first stage blades and the stator vanes are the second stage vanes.

5. The gas turbine engine of claim 1, and further comprising:

The cooling air injection slots have a converging shape in the direction of the cooling air flow from the impingement cavity.

6. The gas turbine engine of claim 1, and further comprising:

The cooling air injection slots have an injection direction inline with the downstream wall and slightly radial in height.

7. The gas turbine engine of claim 1, and further comprising:

The cooling air injection slots have an injection direction parallel to the outer surface of the vane endwall surface.

8. A turbine blade for use in a gas turbine engine, the turbine blade comprising:

A leading edge and a trailing edge;

A pressure side wall and a suction side wall extending between the leading edge and the trailing edge forming an airfoil of the blade A platform from which the airfoil extends;

A row of exit cooling holes located along the trailing edge of the airfoil;

An impingement cavity located adjacent to the exit cooling holes to supply cooling air to the exit cooling holes;

A cooling air injection slot formed within the platform and connected to the impingement cavity; and, The cooling air injection slot directed to discharge cooling air toward a region on an adjacent stator vane where the vane airfoil merges with an inner endwall of the vane to break down a vortex flow on the vane.

9. The turbine blade of claim 8, and further comprising:

The cooling air injection slot is located below the exit cooling holes in the trailing edge of the blade.

10. The turbine blade of claim 8, and further comprising:

The cooling air injection slot has a width of at least twice the height.

11. The turbine blade of claim 8, and further comprising:

The cooling air injection slot has a converging shape in the direction of the cooling air flow from the impingement cavity.

12. The turbine blade of claim 8, and further comprising:

The cooling air injection slot has an injection direction inline with the downstream wall and slightly radial in height.

13. The turbine blade of claim 8, and further comprising:

The cooling air injection slot has an injection direction parallel to the outer surface of the vane endwall surface.

14. A process for breaking down a vortex flow formation formed by a combination of hot flow core gas radial velocity and static pressure gradient forces at an intersection of a stator vane airfoil leading edge and the stator vane endwall in a gas turbine engine, the process comprising the steps of:

Discharging cooling air through exit holes in the trailing edge region to provide cooling for the trailing edge of the rotor blade;

Bleeding off a portion of the cooling air through the rotor blade platform to provide cooling for the platform; and, Discharging the platform cooling air into a region of an adjacent stator vane in a direction where the vane airfoil and the vane endwall merge to reduce the formation of the vortex flow.

15. The process for breaking down a vortex flow formation of claim 14, and further comprising the step of:

Accelerating the cooling air in the platform prior to being discharged toward the stator vane.

16. The process for breaking down a vortex flow formation of claim 15, and further comprising the step of:

Discharging the cooling air from the platform slightly above the adjacent vane endwall surface.

17. The process for breaking down a vortex flow formation of claim 16, and further comprising the step of:

Discharging the cooling air from the platform in a direction inline to the vane downstream endwall outer surface.

* * * * *